US006752132B2

(12) United States Patent
Remmels et al.

(10) Patent No.: US 6,752,132 B2
(45) Date of Patent: Jun. 22, 2004

(54) EXHAUST GAS RECIRCULATION DEVICE

(75) Inventors: Werner Remmels, Immenstaad (DE); Peter Mattes, Markdorf (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 53 days.

(21) Appl. No.: 10/149,707

(22) PCT Filed: Dec. 12, 2000

(86) PCT No.: PCT/EP00/12573

§ 371 (c)(1),
(2), (4) Date: Jun. 14, 2002

(87) PCT Pub. No.: WO01/44650

PCT Pub. Date: Jun. 21, 2001

(65) Prior Publication Data

US 2002/0189598 A1 Dec. 19, 2002

(30) Foreign Application Priority Data

Dec. 17, 1999 (DE) ..... 199 60 998

(51) Int. Cl.[7] ..... F02M 25/07
(52) U.S. Cl. ..... 123/568.11; 123/568.12
(58) Field of Search ..... 123/568.11, 568.12, 123/568.13, 568.18

(56) References Cited

U.S. PATENT DOCUMENTS 4,284,056 A * 8/1981 Sugasawa ..... 123/568.11

* cited by examiner

*Primary Examiner*—Tony M. Argenbright
*Assistant Examiner*—Hyder Ali
(74) *Attorney, Agent, or Firm*—Crowell & Moring LLP

(57) ABSTRACT

A device for recirculating exhaust gas during the operation of multi-cylinder internal combustion engines. The cylinders of the internal combustion engine are divided into two groups. The waste gas of one group, preferably of one cylinder, can be supplied to the suction line of the internal combustion engine via an exhaust gas recirculation line. The exhaust gas recirculation line is controlled by a controllable valve in said recirculation line. A non-return valve which is preferably configured as a non-return flap in the exhaust gas collector line of the internal combustion engine automatically closes or opens a passage between two regions of the exhaust gas collector line according to the position of the valve device in the exhaust gas recirculation line. The non-return valve can be easily integrated into the exhaust gas collector line without the need for a specific control, even when there is very little room available.

12 Claims, 1 Drawing Sheet

EXHAUST GAS RECIRCULATION DEVICE

BACKGROUND AND SUMMARY OF THE INVENTION

The invention relates to a device for recirculating exhaust gas during the operation of multi-cylinder internal-combustion engines.

Exhaust gas recirculation is an effective measure for lowering the nitrogen oxide emissions of internal-combustion engines. A device for recirculating exhaust gas is known, for example, from U.S. Pat. No. 5,517,976. There, the cylinders of a supercharged internal-combustion engine are divided into two groups. The waste gas of one group, preferably of a cylinder, is fed by way of an exhaust gas recirculation line, to the intake line of the internal-combustion engine. The waste gas of the other cylinder group is collected in an exhaust gas collection line and is fed to the turbine of an exhaust gas turbocharger. The exhaust gas recirculation line and the exhaust gas collection line are mutually connected by way of a connection line and a valve device which controls a flow cross-section of the connection line.

An analogous device is also illustrated in German Patent Document DE 39 30 243 A1, where a 3/2-way valve is used for switching off exhaust gas recirculation when the internal-combustion engine is cold and the load is low. When the exhaust gas recirculation is switched off, the exhaust gas of the cylinder connected with the exhaust gas recirculation line is directed to the exhaust gas collection line connected to the remaining cylinders. This type of device, which divides the cylinders into two groups, one of which is provided for the exhaust gas recirculation, presents the problem that an arrangement of a valve device is required in the region of the exhaust gas collection line having limited installation space. When the exhaust gas collection line is cooled, the passing of the drive shaft through the water cooling jacket can, in addition, be achieved only at high constructive expenditures.

U.S. Pat. No. 4,249,382 discloses another device that uses a group of exhaust gas cylinders for recirculating exhaust gas. Here, a valve device having two valves is used for controlling the exhaust gas flows. In an embodiment described in the document, a non-return valve is used to prevent combustion air from the air supply line from entering the exhaust gas recirculation line.

German Patent Document DE 19521573 A1 shows a supercharged internal-combustion engine with an exhaust gas recirculation which contains a non-return flap in the exhaust gas recirculation line and a valve for switching off the exhaust gas recirculation. The recirculated exhaust gas is taken from an exhaust gas collection line to which all cylinders of the internal-combustion engine are connected. The disadvantage of this construction is that the exhaust gas composition of the recirculated gas cannot be optimally adjusted because each cylinder cannot be controlled to influence the exhaust gas quality of the recirculated exhaust gas.

The invention addresses the problem of providing a valve device for the exhaust gas recirculation, which requires low constructive expenditures in the region of the exhaust gas collection line. The valve is used for internal-combustion engines having two groups of cylinders, one of which ("dispenser cylinders") provides the exhaust gas for exhaust gas recirculation.

This object is achieved by a valve device described as follows. A nonreturn valve, preferably a flap with a restoring spring divides the exhaust gas collection pipe into two sections. The integration of a non-return valve with a control in the exhaust gas collection line presents no constructive problems even under limited space conditions. The recirculated exhaust gas flows are controlled by a controllable valve in the exhaust gas recirculation line. The arrangement of a controllable valve, together with the drive shaft and the servo motor, in the exhaust gas recirculation line, will cause no problem because of the space available there. In this manner, a solution is achieved which is favorable with respect to the constructive expenditures and the cost.

The invention will be explained in detail by means of an illustrated embodiment.

DETAILED DESCRIPTION OF THE DRAWINGS

Figure 1:
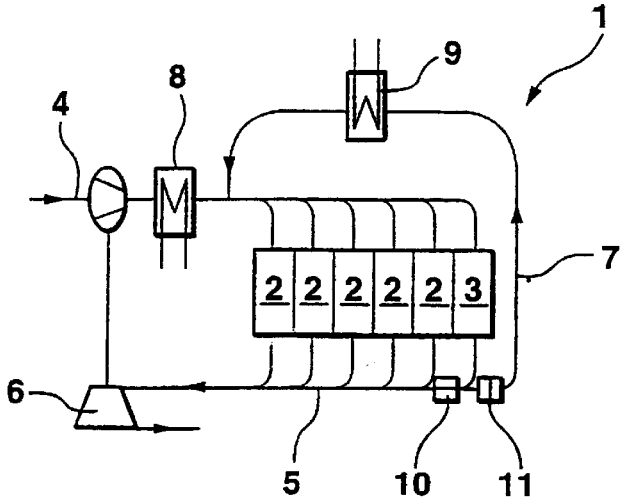
FIG. 1 is a system diagram of an internal-combustion engine with a separate group of cylinders for the exhaust gas recirculation.

FIG. 1 is a system diagram of an internal-combustion engine 1 with the line system for combustion air and exhaust gas. The combustion air is supplied to the cylinder groups 2, 3 of the internal-combustion engine 1 by way of an intake line 4 which contains the compressor of an exhaust gas turbocharger. The exhaust gas of the cylinder groups 2, 3 is collected in an exhaust gas collection line 5 which contains the turbine 6 of the exhaust gas turbocharger. Furthermore, the exhaust gas collection line 5 is connected to an exhaust gas recirculation line 7 which is connected to the intake line 4. For cooling the air and exhaust gas flows, heat exchangers 8, 9 may be provided. The exhaust gas recirculation is controlled by valves 10 and 11, which are arranged in the exhaust gas collection line 5 and in the exhaust gas recirculation line 7. The valve 10, which is a non-return valve and which is situated in the exhaust gas collection line 5 between the connections of the cylinder groups 2 and 3, separates two regions of the exhaust gas collection line 5.

Figure 2A:
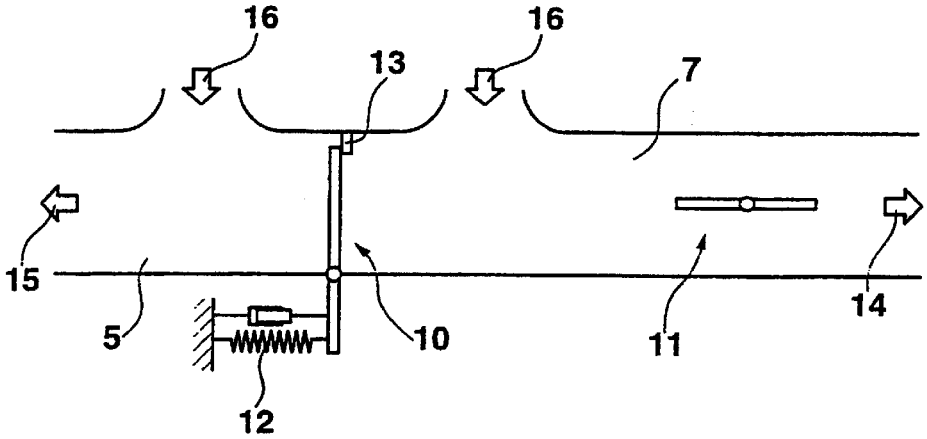
FIG. 2*a* is a view of a section of the exhaust gas line in which a valve device constructed with two flaps is illustrated in the position during the exhaust gas recirculation.
Figure 2B:
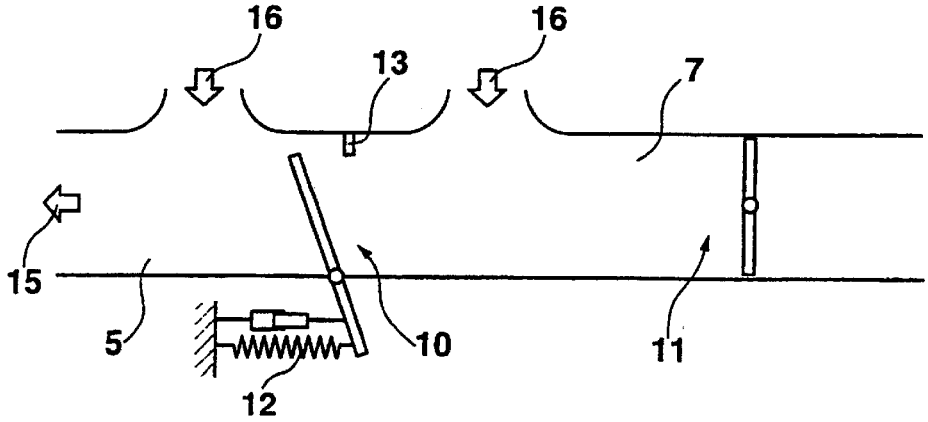
FIG. 2*b* is a view of a section of the exhaust gas line corresponding to FIG. 2*a*, the flaps being in the position while the exhaust gas recirculation is switched off.

In FIGS. 2*a* and 2*b*, the exhaust gas line system is in each case illustrated in the region of the valve device including valves 10 and 11 for recirculating the exhaust gas. At the position of the valves according to FIG. 2*a*, a recirculation of the exhaust gas of the cylinder 3 takes place, and in the position of the valves according to FIG. 2*b*, the exhaust gas recirculation is switched off, so that the exhaust gas of all cylinder groups 2, 3 reaches the turbine 6.

The valves 10 and 11 are constructed as flaps. The valve 11 arranged in the exhaust gas recirculation line 7 can be switched as a function of engine operating parameters into an opened position for the exhaust gas recirculation (FIG. 2*a*) and a closed position (FIG. 2*b*), at which no exhaust gas recirculation takes place. Because of the return stroke function of the valve 10, only the exhaust gas of the cylinder 3 is recirculated.

During the exhaust gas recirculation, the valve 10 arranged in the exhaust gas collection line 5 is held in a closed position against an abutment 13, as illustrated in FIG. 2*a*, because of the pressure conditions and as a result of a restoring spring 12. The restoring force of the spring is selected such that, in coordination with the existing pressure conditions, the desired opening and closing conditions are met. A damping element, which is applied to the flap, prevents wobbling movements caused by pressure surges. The direction of the exhaust gas flows is indicated by arrows 14, 15 and 16.

When the valve 11 is moved into the closed position to switch off the exhaust gas recirculation, the valve 10 automatically opens up because of the pressure difference occurring in the regions of the exhaust gas collection line separated from the valve 10. As a result, a passage is created by way of which the exhaust gas of the cylinder 3 flows over into the section of the exhaust gas collection line connected with the turbine 6. All exhaust gas of all cylinders reaches the turbine 6.

In order to vary the recirculated exhaust gas rate, it is also possible to only partially open the valve 11 in the exhaust gas recirculation line 7. As a result, only a portion of the exhaust gas of the cylinder 3 (dispenser cylinder) is recirculated into the intake line, while the other portion, together of the exhaust gas of the remaining cylinders 2, arrives at the exhaust gas turbine. The exhaust gas pressure in the exhaust gas recirculation line is dependent on, among other things, the opening of the valve 11. The larger the opening of the valve 11, the lower the exhaust gas pressure in the exhaust gas recirculation line because of the back pressure, and the larger the recirculated exhaust gas quantity. The position of the valve 10 depends on the position of the valve 11.

The illustrated valve device including the valves 10 and 11 for the exhaust gas recirculation permits a constructively simple design in the region of the exhaust gas collection line 7, because, as a result of the arrangement of a controllable valve device in the exhaust gas recirculation line 7, an automatic non-return valve is sufficient in the exhaust gas collection line. The non-return valve constructed as a spring-loaded flap can be placed in narrow installation conditions without any high-expenditure constructive measures. In the case of a cooled exhaust gas collection line, particularly also the high-expenditure passage of the required drive shaft through the water cooling jacket will be eliminated.

Furthermore, the use of an automatic flap in the exhaust gas collection line has the advantage that it can serve as a safety device in the event that the exhaust gas of the dispenser cylinder can not flow off, for example, in the case of a defect of the valve 11, in the event of disturbances in the control, when the exhaust gas cooler or other components in the recirculation line are dirty or clogged.

What is claimed is:

1. A device for recirculating exhaust gas in the case of a multi-cylinder internal-combustion engine, comprising an intake line for supplying combustion air to cylinders of the internal combustion engine, an exhaust gas collection line for discharging exhaust gas from the cylinders of the internal-combustion engine, a valve in the exhaust gas collection line between two regions of the exhaust gas collection line assigned to two groups of cylinders, and a region of the exhaust gas collection line being connectable with an exhaust gas recirculation line which leads into the intake line, wherein the valve arranged in the exhaust gas collection line is an automatic non-return valve which, as a function of the existing pressure difference, permits a flowing over of exhaust gas from the region of the exhaust gas collection line connected with the exhaust gas recirculation line into the other region of the exhaust gas collection line bounded by the valve, but prevents a flow in the reverse direction by closing, and, in addition, a controllable valve is arranged in the exhaust gas recirculation line which controls a flow cross-section of the exhaust gas recirculation line.

2. The device according to claim 1, wherein the non-return valve is constructed as a flap valve which is acted upon by a restoring spring in the closing direction until it impacts on an abutment.

3. The device according to claim 1, wherein the controllable valve controls the flow cross-section in the exhaust gas recirculation line as a function of engine operating parameters.

4. Device according to claim 2, wherein the valve controls the flow cross-section in the exhaust gas recirculation line as a function of engine operating parameters.

5. A device for recirculating exhaust gas of an internal combustion engine, the engine including an intake line, an exhaust gas line having first and second regions, first and second groups of cylinders operatively associated with the first and second regions of the exhaust gas line, respectively, and an exhaust gas recirculation line connecting the first region of the exhaust gas line to the intake line, comprising:

an automatic non-return valve positioned in the exhaust gas line between the first and second regions, the automatic non-return valve allowing exhaust flow from the first region to the second region but preventing exhaust flow from the second region to the first region; and a controllable valve positioned in the exhaust gas recirculation line, the controllable valve being configured to control exhaust flow from the first region of the exhaust gas line to the intake line.

6. The device according to claim 5, wherein the non-return valve includes a flap valve, a restoring spring biasing the flap valve against the closed position.

7. The device according to claim 6, wherein the controllable valve is configured to control exhaust flow from the first region of the exhaust gas line to the intake line as a function of an engine operating parameter.

8. The device according to claim 5, wherein the controllable valve is configured to control exhaust flow from the first region of the exhaust gas line to the intake line as a function of an engine operating parameter.

9. A method for making a device for recirculating exhaust gas of an internal combustion engine, the engine including an intake line, an exhaust gas line having first and second regions, first and second groups of cylinders operatively associated with the first and second regions of the exhaust gas line, respectively, and an exhaust gas recirculation line connecting the first region of the exhaust gas line to the intake line, comprising:

positioning an automatic non-return valve in the exhaust gas line between the first and second regions, the automatic non-return valve allowing exhaust flow from the first region to the second region but preventing exhaust flow from the second region to the first region, and positioning a controllable valve in the exhaust gas recirculation line, the controllable valve being configured to control exhaust flow from the first region of the exhaust gas line to the intake line.

10. The method according to claim 9, wherein the non-return valve includes a flap valve, a restoring spring biasing the flap valve against the closed position.

11. The method according to claim 10, further comprising:

configuring the controllable valve to control exhaust flow from the first region of the exhaust gas line to the intake line as a function of an engine operating parameter.

12. The method according to claim 9, further comprising configuring the controllable valve to control exhaust flow from the first region of the exhaust gas line to the intake line as a function of an engine operating parameter.

* * * * *